US007744258B2

(12) United States Patent
Liu et al.

(10) Patent No.: US 7,744,258 B2
(45) Date of Patent: Jun. 29, 2010

(54) OUTDOOR LED LAMP ASSEMBLY

(75) Inventors: You-Xue Liu, Shenzhen (CN); Li He, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 215 days.

(21) Appl. No.: 12/133,400

(22) Filed: Jun. 5, 2008

(65) Prior Publication Data

US 2009/0251906 A1 Oct. 8, 2009

(30) Foreign Application Priority Data

Apr. 3, 2008 (CN) ..... 2008 1 0066503

(51) Int. Cl.
*F21V 29/00* (2006.01)

(52) U.S. Cl. ..... 362/373; 362/294; 362/547

(58) Field of Classification Search ..... 362/373, 362/294, 545, 547, 396
See application file for complete search history.

(56) References Cited

U.S. PATENT DOCUMENTS 3,961,174 A * 6/1976 Blaylock ..... 362/317
7,285,903 B2 * 10/2007 Cull et al. ..... 313/500
7,344,296 B2 * 3/2008 Matsui et al. ..... 362/652
7,434,959 B1 * 10/2008 Wang ..... 362/249.01
7,510,400 B2 * 3/2009 Glovatsky et al. ..... 439/56
7,513,639 B2 * 4/2009 Wang ..... 362/218
7,549,772 B2 * 6/2009 Wang ..... 362/294
7,607,803 B2 * 10/2009 Zhang et al. ..... 362/294
7,611,270 B1 * 11/2009 Lyons et al. ..... 362/543

FOREIGN PATENT DOCUMENTS

CN 1704315 A 12/2005
CN 2795108 Y 7/2006
CN 1834522 A 9/2006
CN 101105278 A 1/2008

* cited by examiner

*Primary Examiner*—Ali Alavi
(74) *Attorney, Agent, or Firm*—Frank R. Niranjan

(57) ABSTRACT

An outdoor LED lamp assembly includes a receiving member and an LED lamp mounted on the receiving member. The LED lamp includes a heat sink and a plurality of LED modules mounted on the heat sink. The receiving member includes a bottom plate. A plurality of screw assemblies extends through the bottom plate to engage with the receiving member to mount the bottom plate on the receiving member. Each of the screw assemblies includes a screw and a circlip snapping the screw. The screw includes a head and a thread portion extending from the head. The threaded portion threadedly engages in the receiving member. The bottom plate of the receiving member is sandwiched between the head and the circlip. A wire interconnects the receiving member and the bottom plate. The screws are remained on the bottom plate when the screws are loosened from the receiving member.

16 Claims, 8 Drawing Sheets

OUTDOOR LED LAMP ASSEMBLY

BACKGROUND OF THE INVENTION

1. Field of the Invention

The present invention relates to an outdoor LED lamp assembly, and more particularly to an outdoor LED lamp assembly having a plurality of particularly designed screws which are remained on a bottom plate of the LED lamp assembly when the bottom plate of the outdoor LED lamp assembly is disassembled for proceeding with repair or maintenance of the LED lamp assembly.

2. Description of Related Art

A conventional outdoor LED lamp assembly comprises a driving circuit module assembly and an LED lamp electronically connecting with the driving circuit module assembly. The driving circuit module assembly comprises a bottom plate. A plurality of screws extends through the bottom plate and engages with the driving circuit module to mount the bottom plate on the driving circuit module assembly. The screws can easily drop from the bottom plate when the screws are loosened from the bottom plate so that the bottom plate can be removed from the driving circuit module assembly in order to proceed with a repair or maintenance of the outdoor LED lamp assembly.

What is needed, therefore, is an outdoor LED lamp assembly having a plurality of screws which are still remained on a bottom plate of the outdoor LED lamp assembly when the bottom plate of the outdoor LED lamp assembly is disassembled therefrom.

SUMMARY OF THE INVENTION

An outdoor LED lamp assembly includes a receiving member and an LED lamp mounted on the receiving member. The LED lamp includes a heat sink and a plurality of LED modules mounted on the heat sink. The receiving member includes a bottom plate. A plurality of screw assemblies extends through the bottom plate to engage with the receiving member to mount the bottom plate on the receiving member. Each of the screw assemblies includes a screw and a circlip snapping with the screw. The screw includes a head and a thread portion extending from the head. The bottom plate of the receiving member is sandwiched between the head and the circlip. Thus, when the screws are loosened from the receiving member, the screws are still remained on the bottom plate to prevent the screws from dropping from the LED lamp assembly. A wire interconnects the bottom plate and the receiving member whereby the bottom plate is still attached to the receiving member even when the screws are all loosened from the receiving member.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
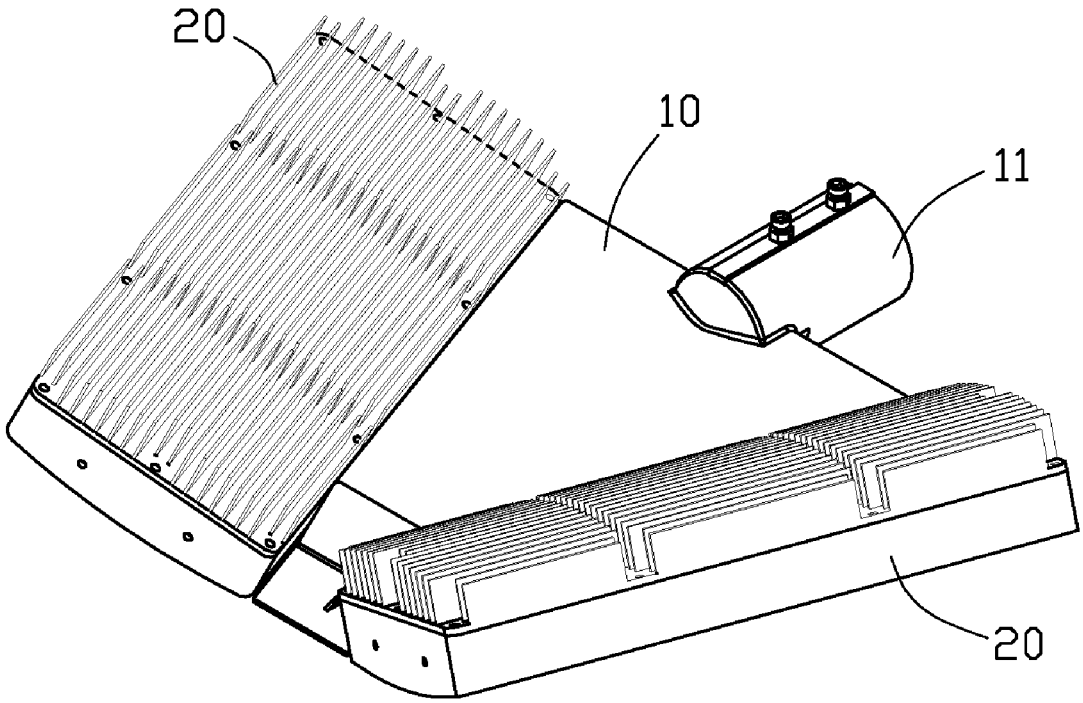
FIG. 1 is an assembled view of an outdoor LED lamp assembly in accordance with a preferred embodiment of the present invention.

Referring to FIG. 1, an outdoor LED lamp assembly (not labeled) comprises a receiving member 10 and a pair of LED lamps 20 assembled on opposite sides of the receiving member 10. A driving circuit module (not shown) is received in the receiving member 10 to electronically connect with and supply power to the LED lamps 20.

Figure 2:
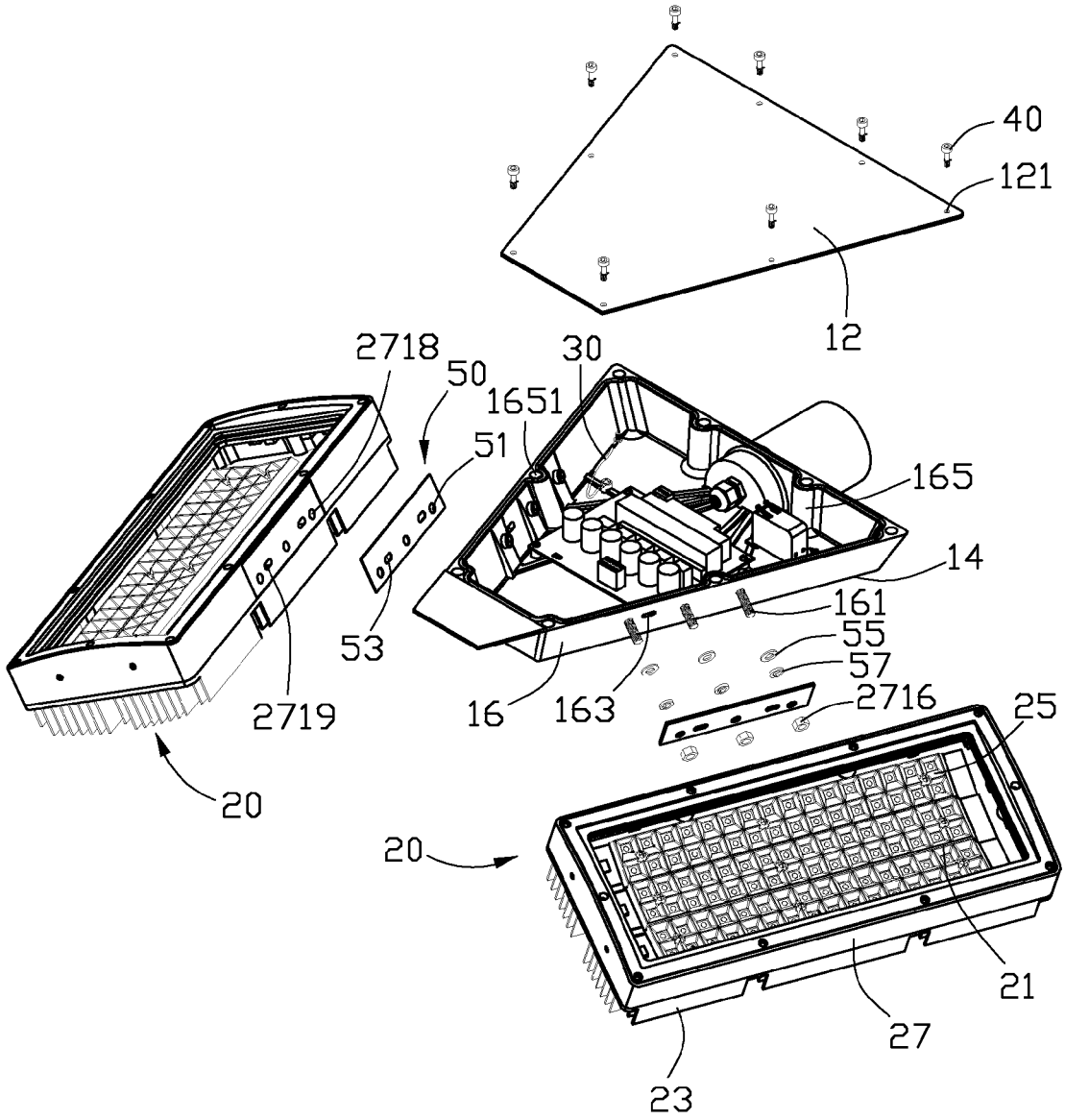
FIG. 2 is an exploded view of FIG. 1, but viewed from a different aspect.
Figure 3:
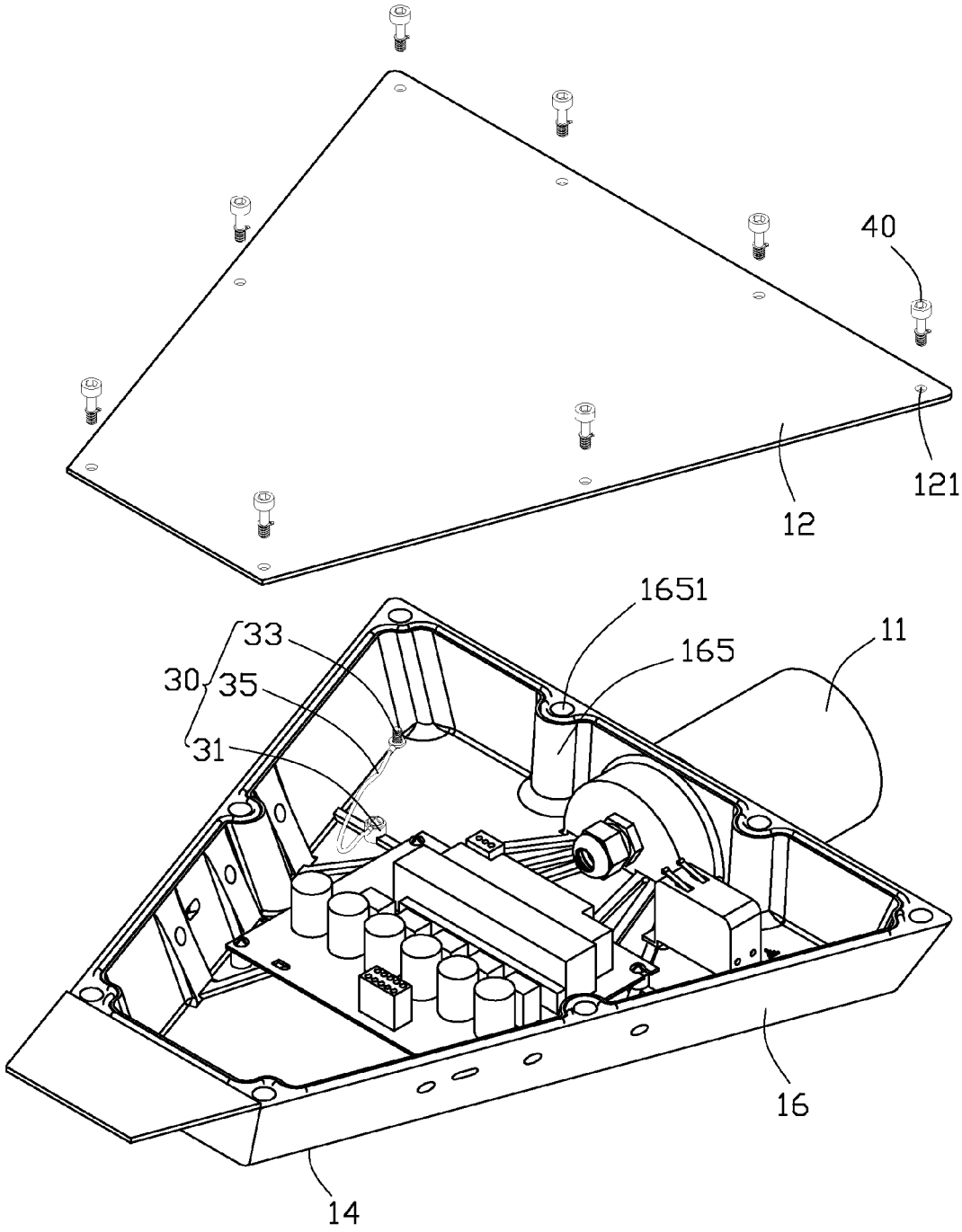
FIG. 3 is an exploded view of a receiving member of FIG. 2.
Figure 4:
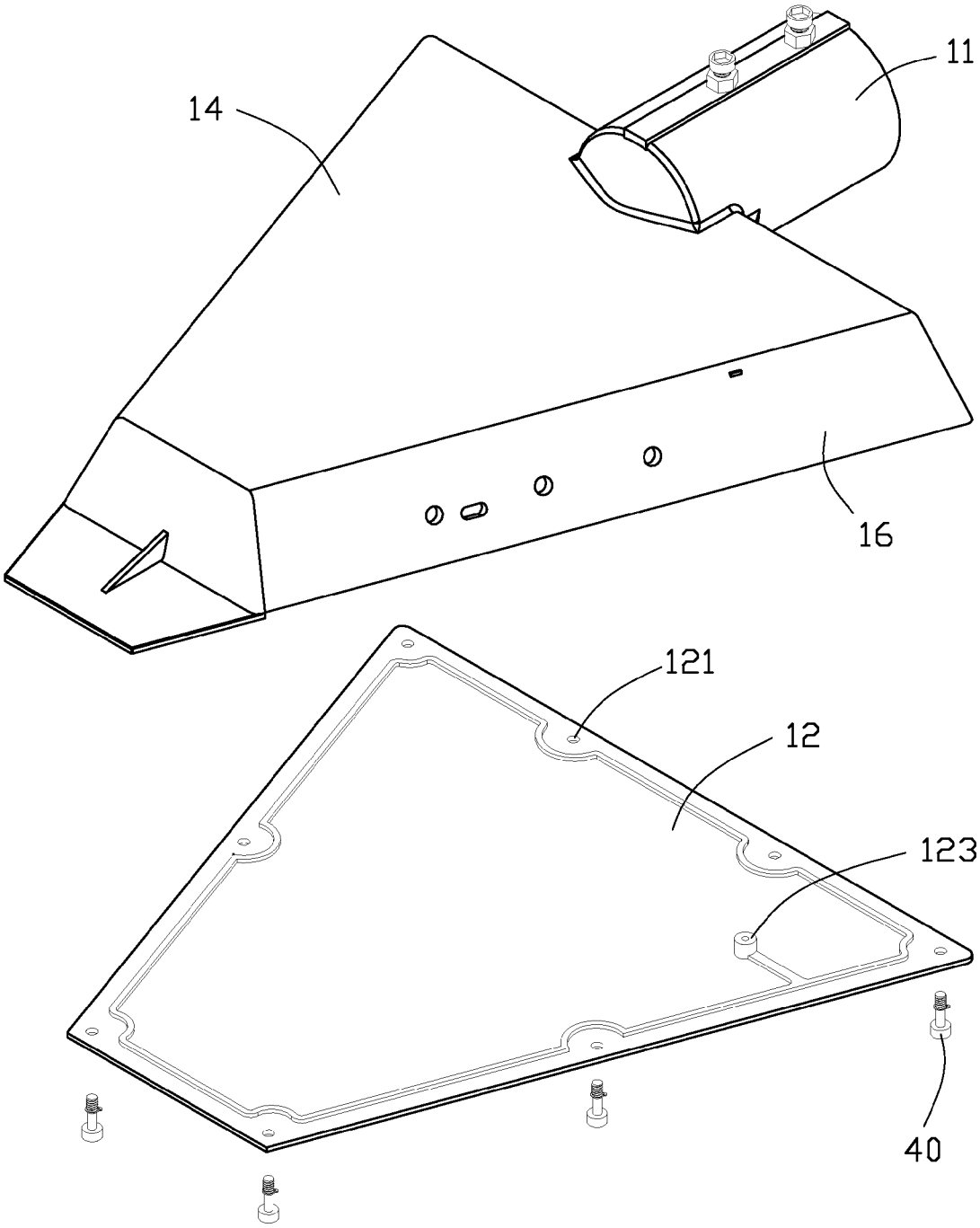
FIG. 4 is an inverted view of FIG. 3.

Referring to FIGS. 2-4, the receiving member 10 has a triangular configuration and consists of a top plate 14, a bottom plate 12 opposite to the top plate 14, a pair of mounting plates 16 connecting right and left edges of the top and bottom plates 14, 12, and a rear plate (not labeled) and a front plate (not labeled) connecting rear and front edges of the top and bottom plates 14, 12 respectively. A lamp holder 11 is secured to the rear plate of the outdoor LED lamp assembly. The lamp holder 11 is provided for securely connecting with a supporting post (not shown) whereby the outdoor LED lamp assembly can be supported by the supporting post. The bottom plate 12 and the top plate 14 are trapeziform and parallel to each other. The bottom plate 12 has a slightly larger area than that of the top plate 14; thus, the mounting plates 16 extend outwardly and downwardly from the edges of the top plate 14 to the edges of the bottom plate 12. In addition, the rear plate is larger than the front plate; thus, the mounting plates 16 extend outwardly and rearwards from the front plate to the rear plate. A plurality of through holes 121 is defined in edges of the bottom plate 12. A post 123 with a screw hole (not labeled) extends upwardly from a top surface (not labeled) of the bottom plate 12. A first screw assembly 30 is mounted on the top plate 14 and engages with the post 123 of the bottom plate 12. A plurality of poles 165 is formed on inner surfaces (not labeled) of the mounting plates 16 and the rear and front plates. Each pole 165 defines a threaded bore 1651 at a centre thereof. A plurality of second screw assemblies 40 extends through the through holes 121 of the bottom plate 12 to be engaged in the threaded bores 1651 of the poles 165 to mount the bottom plate 12 on the receiving member 10. Three spaced elongated screws 161 extend outwardly from each of the mounting plates 16 to engage with the LED lamps 20. A pair of through holes 163 (only one shown) is defined in the mounting plates 16. Electric wires (not shown) extend from the driving circuit module through the through holes 163 to enter the LED lamps 20.

The first screw assembly 30 comprises a first screw 31 mounted on the top plate 14, a second screw 33 engaged in the screw hole of the post 123, and an elongated connecting wire 35 connecting with the first and second screws 31, 33. When the second screw assemblies 40 are demounted from the threaded bores 1651 of the poles 165 of the receiving member 10, the first screw assembly 30 still interconnects the bottom plate 12 and the top plate 14 to prevent the bottom plate 12 from dropping from the outdoor LED lamp assembly.

Figure 5:
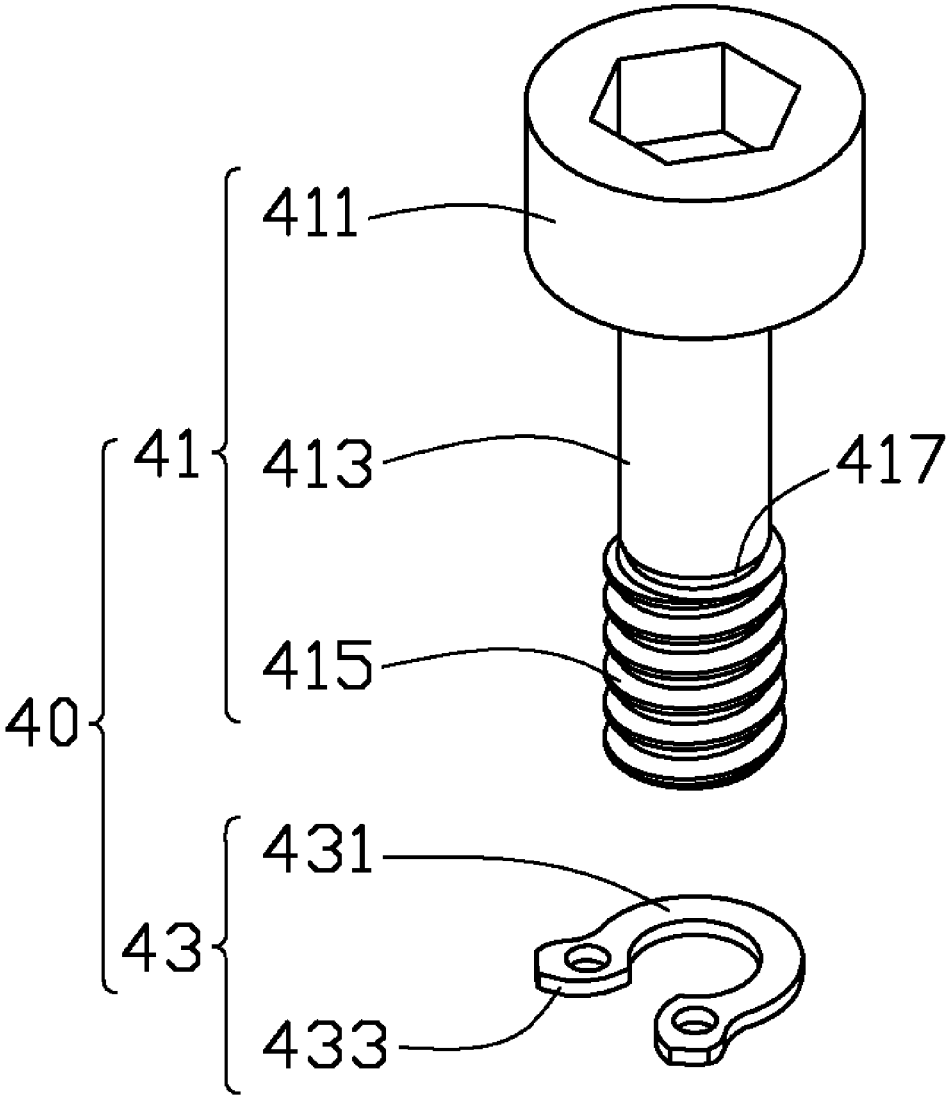
FIG. 5 is an exploded view of a second screw assembly of FIG. 2.
Figure 6:
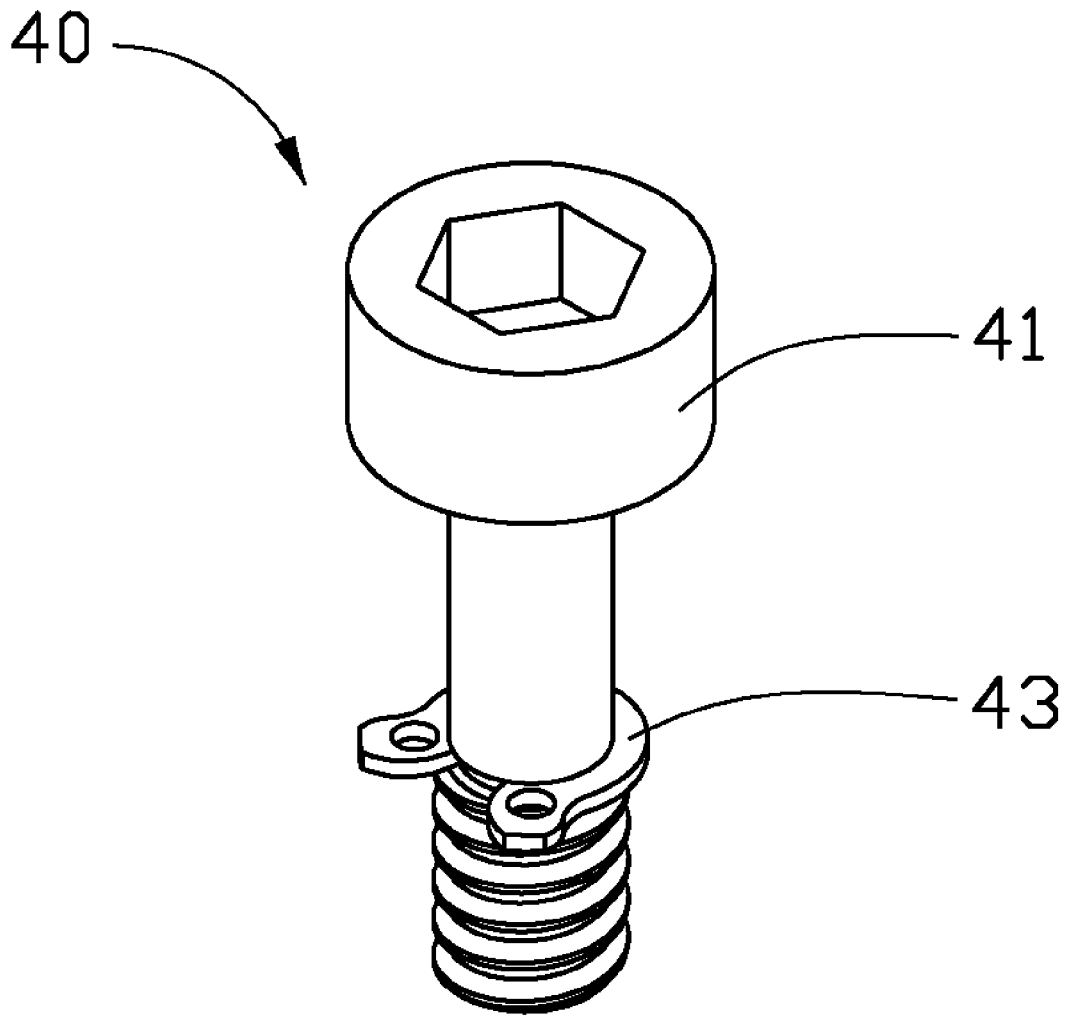
FIG. 6 is an assembled view of the second screw assembly of FIG. 5.

Referring to FIGS. 5-6, each of the second screw assemblies 40 comprises a screw 41 and a C-typed circlip 43 secured on the screw 41. The screw 41 comprises a cylindrical head 411, a cylindrical rod 413 extending downwardly from a centre of the head 411, and a thread portion 415 extending downwardly from the bottom of the rod 413. The head 411 has an outer diameter larger than that of the rod 413. The head 411 defines a hexagonal recess (not labeled) in a center thereof, for fittingly receiving a tool (not shown) to rotate the screw 41. The thread portion 415 has circles of thread (not labeled). A groove 417 is defined at a top of the thread portion 415 to receive the circlip 43 abutting against the thread portion 415. The circlip 43 comprises a C-shaped connecting portion 431 and a pair of operating portions 433 extending outwardly from ends of the connecting portion 431. The operating portions 433 facilitate mounting of the circlip 43 on the screw 41. The thread portion 415 is received in the threaded bore 1651 of a corresponding pole 165. The head 411 of the screw 41 and the circlip 43 are located at opposite sides of the bottom plate 12 of the receiving member 10. The connecting portion 431 has an inner diameter smaller than the outer diameter of the rod 413. Thus, the circlip 43 is securely mounted on the screw 41. The outer diameter of the head 411 and the outer diameter of the circlip 43 are larger than an inner diameter of the through hole 121 of the bottom plate 12. When the thread portion 415 is demounted from the threaded bore 1651 of the pole 165, the screw 41 is remained on the bottom plate 12 because of the head 411 of the screw 41 and circlip 43, which will abut against the bottom plate 12 when the screw 41 is moved along the through hole 121 to opposite extreme positions.

Figure 7:
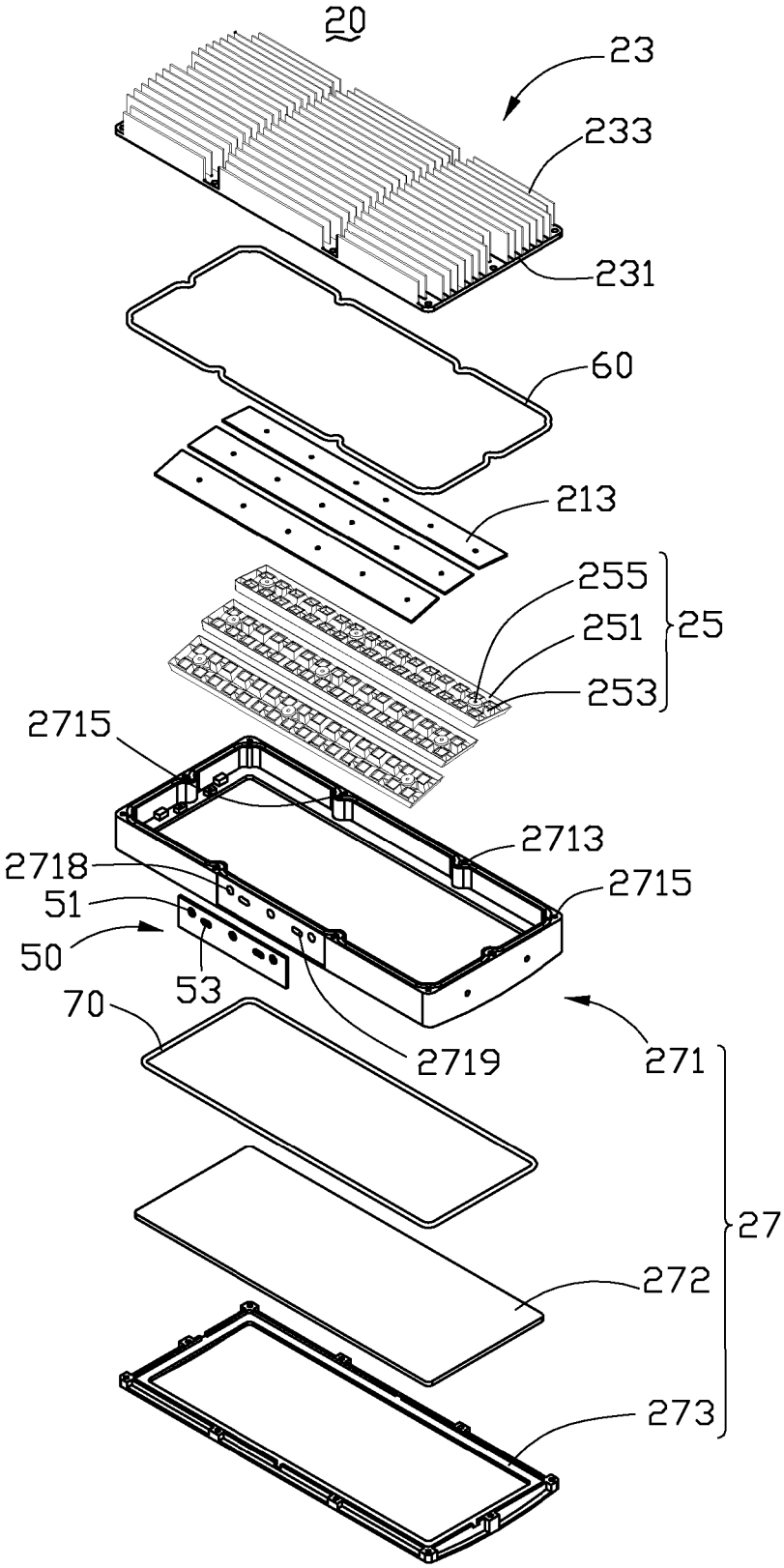
FIG. 7 is an exploded view of an LED lamp of FIG. 2.
Figure 8:
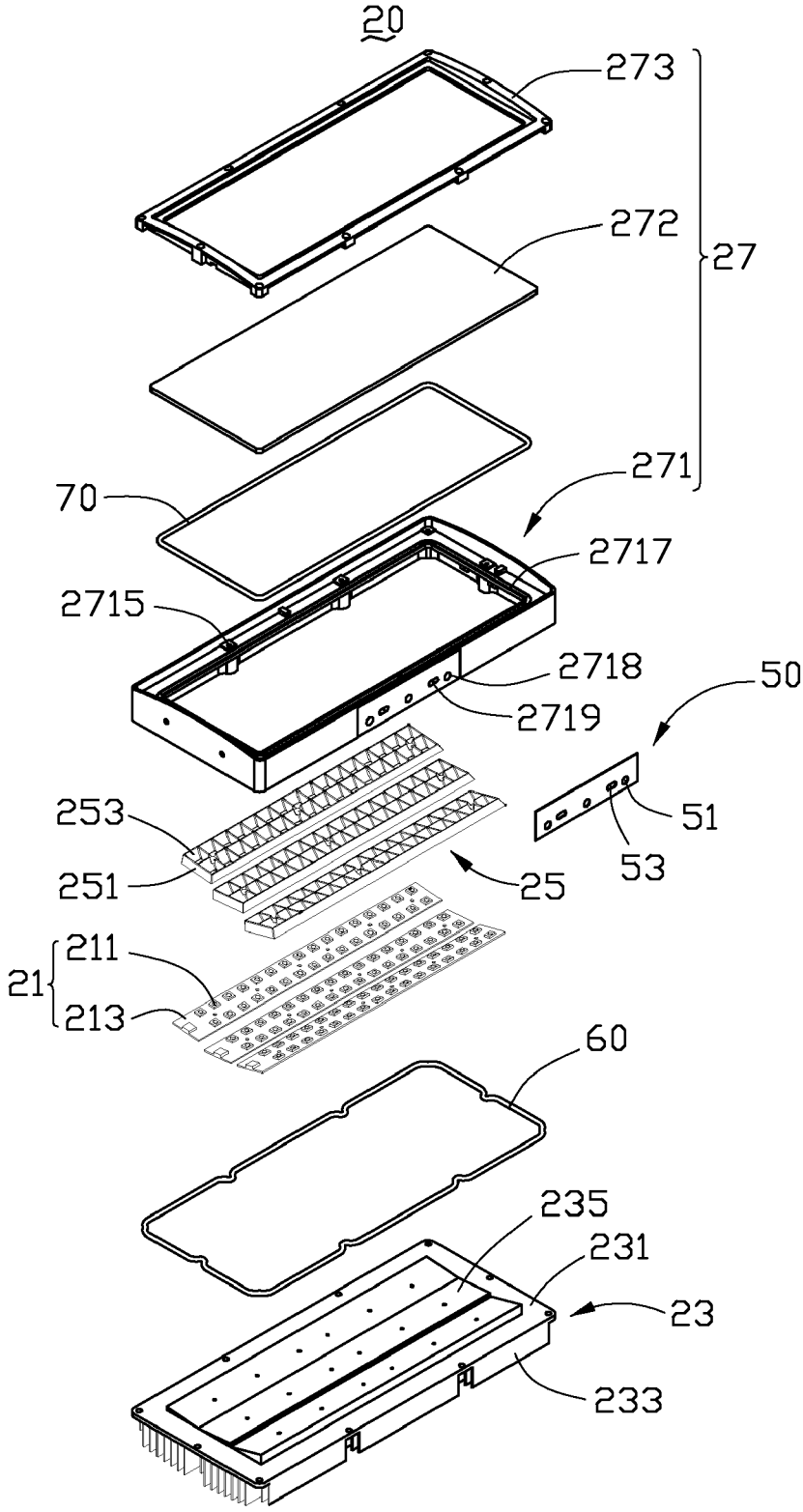
FIG. 8 is an inverted view of FIG. 7.

Referring to FIGS. 7-8, each LED lamp 20 comprises a plurality of LED modules 21, a heat sink 23 supporting and cooling the LED modules 21, a plurality of reflectors 25 over the LED modules 21, and a housing 27 mounted around a periphery of the heat sink 23 to enclose the LED modules 21 and the reflectors 25 therein.

The heat sink 23 is made of a metal with a high degree of heat conductivity, such as copper or aluminum. The heat sink 23 comprises a rectangular base 231 and a plurality of fins 233 extending from the base 231. The base 231 comprises a top plate (not labeled) and a bottom plate (not labeled) opposite the top plate. The fins 233 extend from the top plate of the base 231. A centre of the bottom plate of the base 231 protrudes three elongated planar surfaces 235. The LED modules 21 are attached on the surfaces 235. The surfaces 235 are angled with each other.

Each LED module 21 comprises an elongated printed circuit board 213 and a plurality of spaced LEDs 211 evenly mounted on a side of the printed circuit board 213. The LEDs 211 of each LED module 21 are arranged along a longitudinal direction of the printed circuit board 213. Each LED module 21 is mounted in a thermally conductive relationship with the bottom plate of the heat sink 23 and electronically connects with the driving circuit module.

Each reflector 25 is located over the printed circuit board 213 of a corresponding LED module 21. The reflector 25 comprises a rim 251 and a plurality of ribs (not labeled) within the rim 251. The rim 251 and the ribs connect with each other to define a plurality of through holes 253. The LEDs 211 are received in the through holes 253, respectively. Light generated by the LEDs 211 is reflected by the reflectors 25 to increase the intensity of the light emitted from the LED lamps 20. A plurality of sleeves 255 is formed in the reflector 25 along a thickness direction thereof. A plurality of screws (not shown) are used to extend through the sleeves 255 and the printed circuit boards 213 to engage with the heat sink 23 thereby to mount the reflectors 25 and the LED modules 21 on the heat sinks 23.

The housing 27 comprises a rectangular frame 271 engaging with the heat sink 23, a transparent cover 272 enclosed in the frame 271 and covering a bottom opening (not labeled) of the frame 271, and a rectangular fixture 273 located at a bottom of the frame 271 and mounting the cover 272 on the frame 271.

The frame 271 forms a plurality of protruding portions 2713 on inner surfaces thereof. Each protruding portion 2713 and each corner of the frame 271 define a screw hole 2715 therein. Screws (not shown) extend through the heat sink 23 and engage into a top portion of the screw holes 2715 to mount the frame 271 on the heat sink 23. The LED modules 21 are enclosed in the frame 271. A rectangular ring-shaped gasket 60 is sandwiched between the frame 271 and the heat sink 23 to enhance hermeticity of the connection between the frame 271 and the heat sink 23. A plurality of connecting plates (not labeled) extends inwardly from bottom of the inner surfaces of the frame 271. A plurality of supporting plates 2717 extends inwardly and downwardly from edges of the connecting plates to support the cover 272. The fixture 273 presses the cover 272 against the supporting plates 2717. Screws (not shown) extend through the fixture 273 and engage into a bottom portion of the screw holes 2715 to mount the fixture 273 on the frame 271. A rectangular ring-shaped gasket 70 is sandwiched between the cover 273 and the supporting plates 2717 to enhance hermeticity of the connection between the cover 273 and the supporting plates 2717. A centre of an elongated sidewall (not labeled) of the frame 271 defines three holes 2718 corresponding to the elongated screws 161 of the receiving member 10. A nut 2716 is received in each of the holes 2718 to engage with a corresponding one of the elongated screws 161. Two through holes 2719 are defined between the holes 2718 for extension of the electric wires from the driving circuit module into the LED lamp 20.

A rectangular linking plate 50 is sandwiched between the elongated sidewall of the LED lamp 20 and the mounting plate 16 of the receiving member 10. The linking plate 50 defines three mounting holes 51 corresponding to the holes 2718 of the frame 271 of the LED lamp 20, and two holes 53 corresponding to the through holes 2719 of the frame 271 of the LED lamp 20. The elongated screws 161 extend through the mounting holes 51 of the linking plates 50, O-rings 55, 57 to threadedly engage with the nuts 2716 in the holes 2718 of the frame 271, thereby to mount the LED lamps 20 on the opposite sides of the receiving member 10. In this state, the heat sinks 23 extend outwardly and upwardly from the mounting plates 16 of the receiving member 10, as shown in FIG. 1. By the provision of the mounting plates 16 which are titled outwardly along top-to-bottom direction and tilted outwardly along front-to-rear direction, and the provision of the differently-angled planar surfaces 235 at the bottom the of the heat sinks 23, the LED modules 21 are oriented toward a plurality of different directions, whereby the LED lamp assembly in accordance with the present invention can have a large illumination angle. In addition, since the LED modules 21 have an intimate contact with the heat sinks 23, the heat generated by the LEDs 211 can be timely dissipated to surrounding air by the fins 233 of the heat sinks 23. Thus, the LED lamp assembly can work normally when the LEDs 211 are activated.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An outdoor LED lamp assembly comprising:

a receiving member comprising a bottom plate;

an LED lamp mounted on the receiving member, the LED lamp comprising a heat sink and a plurality of LED modules mounted on the heat sink; and a plurality of screw assemblies extending through the bottom plate to engage with the receiving member to mount the bottom plate on the receiving member;

wherein each of the screw assemblies comprises a screw and a circlip snapping the screw, the screw comprising a head and a thread portion extending from the head to threadedly engage with the receiving member, the bottom plate of the receiving member being sandwiched between the head and the circlip.

2. The outdoor LED lamp assembly as claimed in claim 1, wherein a rod extends downwardly from the head and connects with the thread portion, and a groove is defined at a top of the thread portion to receiving the circlip, the circlip abutting against the top of the thread portion.

3. The outdoor LED lamp assembly as claimed in claim 2, wherein the circlip comprises a C-shaped connecting portion received in the groove and a pair of operating portions extending outwardly from of the connecting portion.

4. The outdoor LED lamp assembly as claimed in claim 3, wherein the head is cylindrical and has a diameter larger than that of the rod.

5. The outdoor LED lamp assembly as claimed in claim 3, wherein the connecting portion of the circlip has an inner diameter smaller than an outer diameter of the rod.

6. The outdoor LED lamp assembly as claimed in claim 2, wherein the receiving member has a triangular configuration and a plurality of poles formed on an inner surface of the receiving member, each of the poles defining a threaded bore at a centre thereof, the thread portion of the screw and the circlip being threadedly received in the threaded bore.

7. The outdoor LED lamp assembly as claimed in claim 1, wherein a wire is used to interconnect the receiving member and the bottom plate of the receiving member to prevent the bottom plate from dropping from the receiving member when the bottom plate is dismounted from the receiving member.

8. The outdoor LED lamp assembly as claimed in claim 7, wherein the wire has a first end attached to the bottom plate by a screw threadedly engaging with the bottom plate and a second end attached to the receiving member by another screw threadedly engaging with the receiving member.

9. The outdoor LED lamp assembly as claimed in claim 8, wherein the receiving member comprises a top plate opposite to the bottom plate, and the bottom plate and the top plate are trapeziform and parallel to each other, and the bottom plate is large than the top plate, the another screw threadedly engaging with the top plate.

10. The outdoor LED lamp assembly as claimed in claim 9, a pair of slope plates extend outwardly and downwardly from edges of the top plate to edges of the bottom plate and the LED lamp extend slantwise and upwardly from one of the slope plates.

11. The outdoor LED lamp assembly as claimed in claim 1, wherein the heat sink comprises a base, the base comprising a bottom plate, a centre of the bottom plate of the base being protruded into a plurality of elongated planar surfaces which are angled with each other, the LED modules being attached on the elongated planar surfaces, respectively.

12. The outdoor LED lamp assembly as claimed in claim 1, wherein the LED lamp comprises a plurality of reflectors over the LED modules, respectively, the reflectors being secured to the heat sink.

13. The outdoor LED lamp assembly as claimed in claim 12, wherein a housing engages with a bottom portion of the heat sink to enclose the LED modules and the reflectors therein.

14. The outdoor LED lamp assembly as claimed in claim 13, wherein the housing comprises a rectangular frame engaging with the heat sink, a transparent cover enclosed in the frame and covering an opening of the frame, and a rectangular fixture located at a bottom of the frame and mounting the cover on the frame.

15. An LED lamp assembly comprising:

a receiving member receiving a drive circuit module therein;

a bottom plate;

a plurality of screws extending through the bottom plate to threadedly engage with the receiving member to thereby mount the bottom plate to the receiving member;

an LED lamp mounted to a side of the receiving member, the LED lamp having a heat sink and a plurality of LED modules mounted on the heat sink; and a wire interconnecting the receiving member and the bottom plate so that when the bottom plate is dismounted from the receiving member by loosening the screws, the bottom plate is still connected with the receiving member, wherein the screws have means for holding the screws on the bottom plate when the screws are loosened from the receiving member.

16. The LED lamp assembly as claimed in claim 15, wherein said means comprises a circlip snapping each of the screws, the bottom plate being located between a head of each of the screws and the circlip.

* * * * *